US009238892B2

(12) United States Patent
Theurer et al.

(10) Patent No.: US 9,238,892 B2
(45) Date of Patent: Jan. 19, 2016

(54) TAMPING PICK

(75) Inventors: Josef Theurer, Vienna (AT); Hebert Woergoetter, Gallneukirchen (AT)

(73) Assignee: Plasser & Theurer, Export von Bahnbaumaschinen, Gesellschaft m.b.H., Vienna (AU)

( * ) Notice: Subject to any disclaimer, the term of this patent is extended or adjusted under 35 U.S.C. 154(b) by 0 days.

(21) Appl. No.: 14/001,498

(22) PCT Filed: Mar. 1, 2012

(86) PCT No.: PCT/EP2012/000888
§ 371 (c)(1),
(2), (4) Date: Aug. 23, 2013

(87) PCT Pub. No.: WO2012/130368
PCT Pub. Date: Oct. 4, 2012

(65) Prior Publication Data

US 2013/0327241 A1 Dec. 12, 2013

(30) Foreign Application Priority Data

Mar. 28, 2011 (AT) ..... 431/2011

(51) Int. Cl.
*E01B 27/20* (2006.01)
*E01B 27/16* (2006.01)
*E01B 27/13* (2006.01)

(52) U.S. Cl.
CPC ..... *E01B 27/20* (2013.01); *E01B 27/13* (2013.01); *E01B 27/16* (2013.01)

(58) Field of Classification Search
CPC ..... E01B 27/16; E01B 27/20; E01B 27/13
USPC ..... 104/10; 172/745; 37/455; 403/16
See application file for complete search history.

(56) References Cited

U.S. PATENT DOCUMENTS

| | | | | |
|---|---|---|---|---|
| 3,971,323 | A * | 7/1976 | Beiswenger | 104/10 |
| 4,392,333 | A * | 7/1983 | Welsch | 451/355 |
| 5,261,763 | A * | 11/1993 | Crowell | 404/133.05 |
| 7,527,452 | B2 | 5/2009 | Theurer et al. | |
| 2005/0109235 | A1 | 5/2005 | Williams | |

FOREIGN PATENT DOCUMENTS

| | | | |
|---|---|---|---|
| CN | 201 598 541 | U | 10/2010 |
| CN | 201598541 | U | 10/2010 |
| EP | 1 329 554 | A1 | 1/1989 |
| FR | 2 617 669 | A1 | 1/1989 |

OTHER PUBLICATIONS

International Search Report of PCT/EP2012/000888, date of mailing May 25, 2013.

* cited by examiner

*Primary Examiner* — Mark Le
(74) *Attorney, Agent, or Firm* — Collard & Roe, P.C.

(57) ABSTRACT

A tamping tine (5) for a tamping machine consists of a tine shaft (8) and, positioned at the lower end thereof, a tine pad (9) having a pad bottom edge (10) spaced from the tine shaft (8). The tine pad (9) has pad side surfaces (11), spaced from one another in the direction of the pad bottom edge (10) and extending perpendicularly to the same, each of which connect a pad front side (12) to a pad rear side of the tine pad (9). Hardened metal plates (14) for increasing the abrasion resistance are fastened to the tine pad (9). The hardened metal plates (14) situated side by side along the pad bottom edge (10) form a common boundary line (15) both on the pad front side (12) as well as on the pad rear side. Armoring (17) in the shape of a build-up welding, standing out from a plane (16) of the pad front- or -rear side, is provided adjoining each boundary line (15).

4 Claims, 3 Drawing Sheets

Fig.1
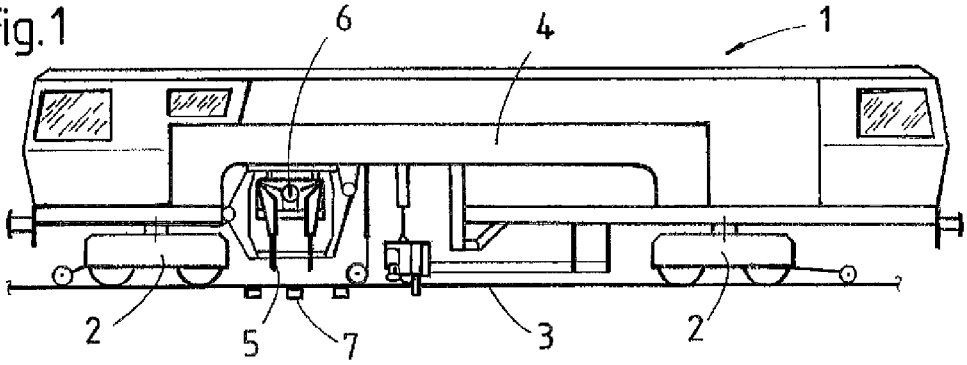
Fig. 2
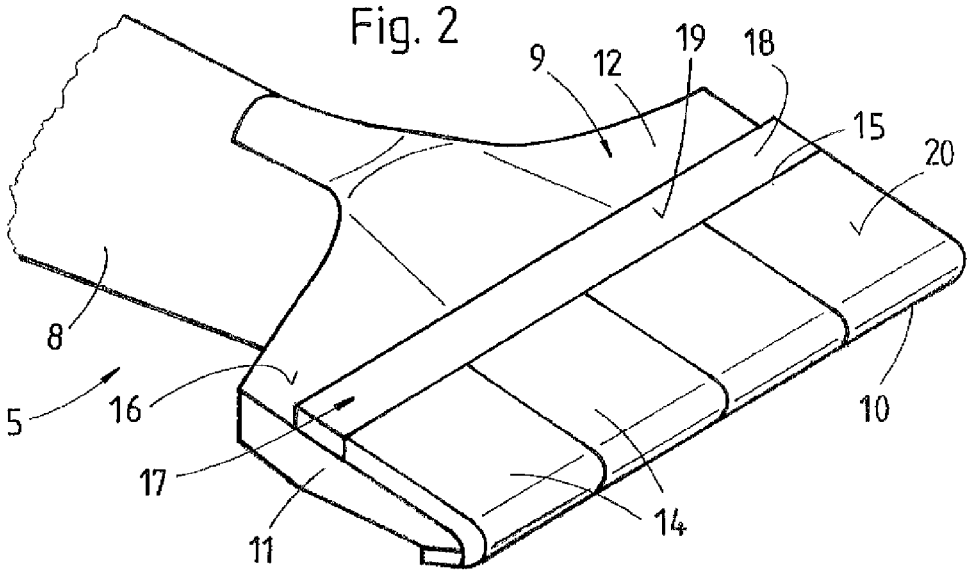
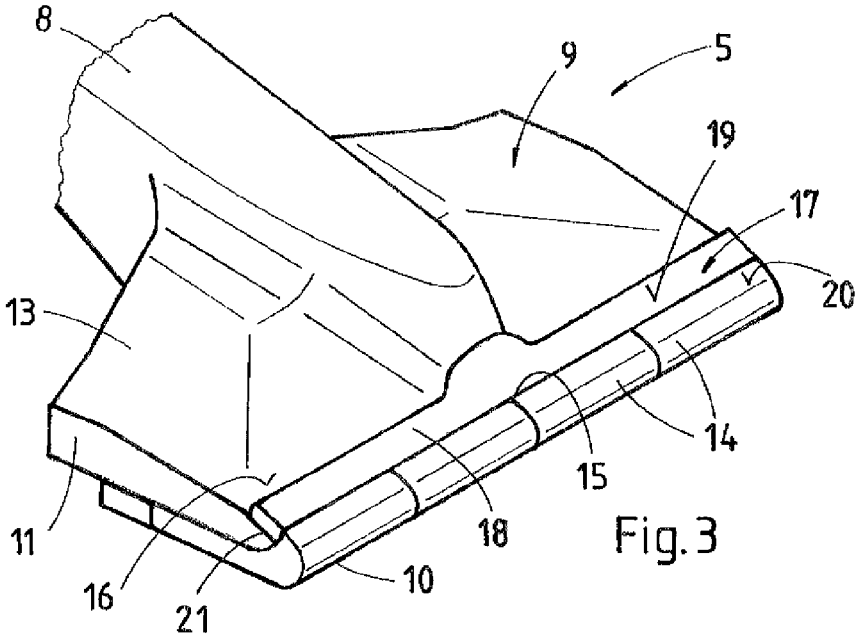
Fig.3

Fig. 7
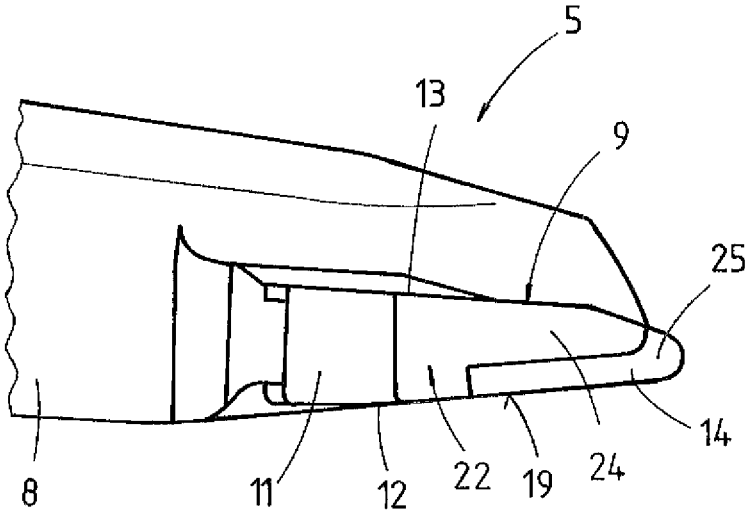
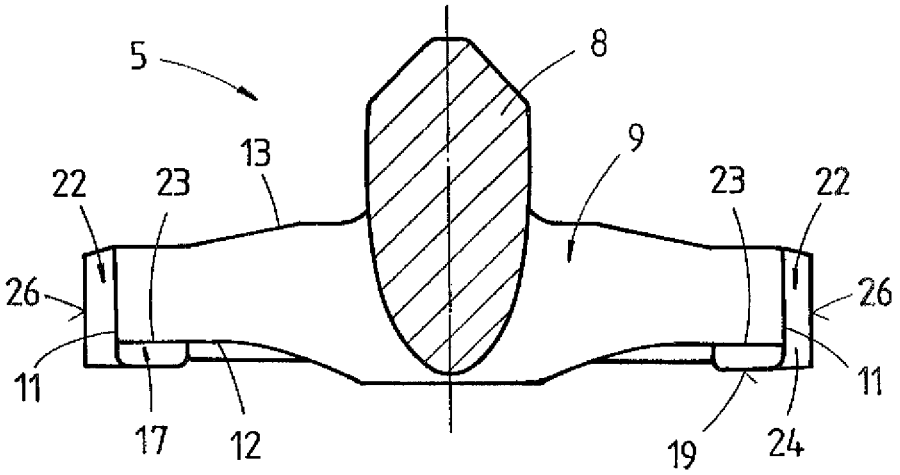
Fig. 6

TAMPING PICK

CROSS REFERENCE TO RELATED APPLICATIONS

This application is the National Stage of PCT/EP2012/000888 filed on Mar. 1, 2012, which claims priority under 35 U.S.C. §119 of Austrian Application No. A 431/2011 filed on Mar. 28, 2011, the disclosure of which is incorporated by reference. The international application under PCT article 21(2) was not published in English.

BACKGROUND

A tamping tine of this type is already known from EP 1 329 554 A1. The entire pad front- and -rear side of the tine pad are covered with hardened metal plates. Provided in the region of the pad side surfaces are cylinder-shaped hardened metal inlays which are positioned in corresponding bores of the tine pad.

It is the object of one embodiment of the present invention to create a tamping tine of the kind mentioned at the beginning which can be fabricated in an efficient manner and at the same time offers high abrasion resistance.

An armoring of this kind leads to optimal protection of the hardened metal plates in the end region thereof. When performing the welding operation, it is possible to use various electrodes, thus enabling the application of different abrasion-resistant materials. Also, it is simple to carry out repairs and touch-ups of the armoring which might become necessary after very long service times of the tamping tines. The operating life of the tamping tine is thus altogether significantly increased. The build-up welding, being less expensive in direct comparison to armoring made of soldered-on hardened metal plates, substantially lowers the total cost of the tamping tine.

BRIEF DESCRIPTION OF THE DRAWINGS

The embodiments of the invention will be described in more detail below with reference to embodiments represented in the drawing in which FIG. 1 shows a side view of a tamping machine, FIGS. 2 and 3 show perspective views of the front and rear side, respectively, of a tamping tine, FIG. 6 shows a view according to arrow VI in FIG. 4, and FIG. 7 shows a side view of a variant of a tamping tine.

DETAILED DESCRIPTION

Figure 4:
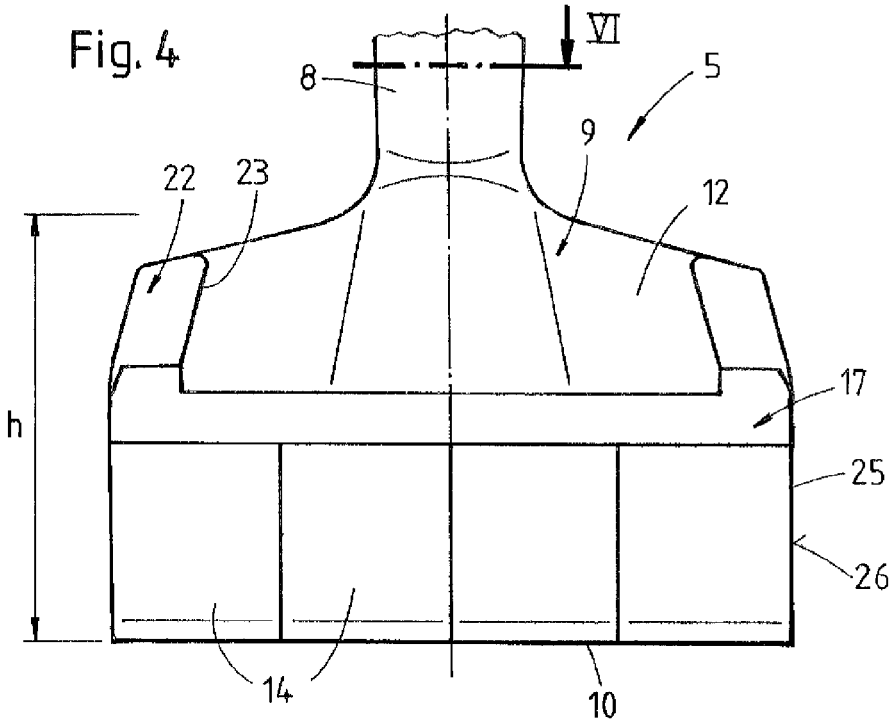
FIGS. 4, 5 show top views.
Figure 5:
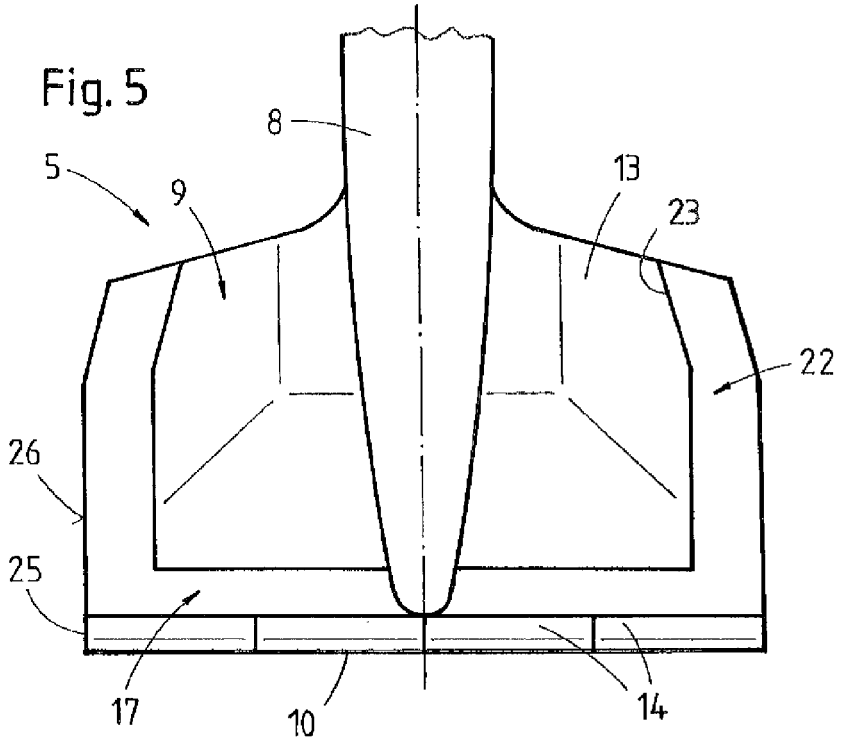

A tamping machine 1 shown in FIG. 1 essentially comprises a machine frame 4 supported via on-track undercarriages 2 on a track 3. A tamping unit 6 for tamping sleepers 7 of the track 3 and having tamping tines 5 is arranged on said machine frame 4.

The tamping tine 5, shown in detail in FIGS. 2 and 3, consists of a tine shaft 8 and, positioned at the lower end thereof, a tine pad 9. The latter has a pad bottom edge 10 spaced from the tine shaft 8. The tine pad 9 further has pad side surfaces 11 spaced from one another in the direction of the pad bottom edge 10 and extending perpendicularly to the same. These pad side surfaces 11 each connect a pad front surface 12 to a pad rear surface 13 of the tine pad 9. Fastened to the latter are hardened metal plates 14 for increasing the resistance to abrasion. The hardened metal plates 14, situated side by side along the pad bottom edge 10, form a common boundary line 15 both on the pad front side 12 as well as on the pad rear side 13. A build-up welding standing out from a plane 16 of the pad front- or -rear side 12, 13 is provided as armoring 17 in the form of a substantially rectangular armoring plate adjoining each boundary line 15. The armoring 17 is formed in the shape of a milling-off weld bead 18 having a substantially rectangular cross-section transverse to a longitudinal direction of the weld bead 18 extending parallel to the boundary line 15. Each boundary line 15 and each weld bead 18 is arranged so as to extend parallel to the pad lower edge 10.

Each weld bead 18 has a delimiting plane 19 which is spaced from the pad front- or -rear side 12, 13 and parallel to the same. Said delimiting plane 19 is produced by milling off the weld bead 18 and forms a substantially coplanar extension of a ballast contact surface 20 formed by the hardened metal plates 14. The armoring 17 connected to the pad front side 12 is positioned approximately centrally with regard to a pad height h (FIG. 4). The armoring 17 connected to the pad rear side 13 is positioned in a section 21 immediately adjoining the pad bottom edge 10 (FIG. 3).

FIGS. 4 to 7 show a tamping tine 5 having armoring 17, arranged on the pad front- and -rear side 12, 13, which is linked by lateral armoring 22 connected in each case to the pad side surface 11. Said lateral armoring 22 also extends over the regions 23 of the pad front- and -rear side 12, 13 which adjoin the pad side surfaces 11. The lateral armoring 22, formed likewise of weld beads 24, is milled off in such a way that a common plane 26 is formed with side surfaces 25 of the hardened metal plates 14. The weld beads 24 located in the regions 23 are advantageously milled off in such a way that they are situated within the delimiting plane 19.

Accordingly, while at least one embodiment of the present invention has been shown and described, it is obvious that many changes and modifications may be made thereunto without departing from the spirit and scope of the invention.

The invention claimed is:

1. A tamping tine for a tamping unit of a tamping machine for tamping a track, comprising:

a tine shaft, a tine pad, positioned at the lower end thereof, having a pad bottom edge spaced from the tine shaft, the tine pad having pad side surfaces spaced from one another in the direction of the pad bottom edge and extending perpendicularly to the same, each of the pad side surfaces connecting a pad front side to a pad rear side of the tine pad, hardened metal plates for increasing the abrasion resistance which are fastened to the tine pad, comprising the following features:

a) the hardened metal plates situated side by side along the pad bottom edge form two boundary lines both on the pad front side as well as on the pad rear side, b) substantially rectangular armoring plates formed by build-up welding, standing out from planes of the pad front and rear sides, are provided adjoining the boundary lines, c) the build-up welding is formed as a milling-off weld bead having a substantially rectangular cross-section transverse to a longitudinal direction of the weld bead extending parallel to each of the boundary lines, d) each boundary line and each weld bead are arranged so as to extend parallel to the pad bottom edge, and e) the weld bead has a delimiting plane, spaced from the pad front- or -rear side and produced by milling, which forms a substantially coplanar extension of a ballast contact surface formed by the hardened metal plates.

2. The tamping tine according to claim 1, wherein the armoring plate connected to the pad rear side is positioned in a section immediately adjoining the pad bottom edge.

3. The tamping tine according to claim 1, wherein the armoring plate connected to the pad front side is positioned approximately centrally with regard to a pad height (h).

4. The tamping tine according to claim 1, wherein the armoring plate arranged on the pad front- or -rear side is linked by lateral armoring connected in each case to the pad side surface.

* * * * *